US008858053B1

(12) United States Patent
Patrick et al.

(10) Patent No.: US 8,858,053 B1
(45) Date of Patent: Oct. 14, 2014

(54) SYSTEMS AND METHODS OF ELIMINATING SHADOWING IN RECESSED LUMINAIRE AND HYDROGRAPHIC PRINTING OF THE SAME

(71) Applicants: Ellis W. Patrick, Sharpsburg, GA (US); Scott David Wegner, Peachtree City, GA (US)

(72) Inventors: Ellis W. Patrick, Sharpsburg, GA (US); Scott David Wegner, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/832,941

(22) Filed: Mar. 15, 2013

Related U.S. Application Data

(60) Provisional application No. 61/644,210, filed on May 8, 2012.

(51) Int. Cl.

| | |
|---|---|
| ***F21V 33/00*** | (2006.01) |
| ***F21V 7/04*** | (2006.01) |
| ***F21S 8/04*** | (2006.01) |

(52) U.S. Cl.
CPC ..... *F21S 8/04* (2013.01)
USPC ..... 362/612; 362/294

(58) Field of Classification Search
CPC ..... F21Y 2101/02; F21Y 2103/003; F21Y 2111/005; F21S 8/02; F21S 48/115; F21S 8/00; H05K 2201/10106
USPC ..... 362/249.02, 612, 84; 359/591, 601, 894
See application file for complete search history.

(56) References Cited

U.S. PATENT DOCUMENTS

| | | | | |
|---|---|---|---|---|
| 2007/0258263 | A1* | 11/2007 | Kim | 362/602 |
| 2013/0213911 | A1* | 8/2013 | Theisen et al. | 211/59.4 |

* cited by examiner

*Primary Examiner* — Tracie Y Green
(74) *Attorney, Agent, or Firm* — King & Spalding

(57) ABSTRACT

The present disclosure provides a recessed luminaire and recessed luminaire frame. The recessed luminaire frame includes a curved inner surface design in which the entire inner surface receives light from the luminaire and thus can be seen. The disclosure further provides a hydrographic printing process in which various desired designs can be printed onto a base material of the frame.

14 Claims, 10 Drawing Sheets

SYSTEMS AND METHODS OF ELIMINATING SHADOWING IN RECESSED LUMINAIRE AND HYDROGRAPHIC PRINTING OF THE SAME

RELATED APPLICATION

The present application claims priority to U.S. Provisional Patent Application No. 61/644,210 titled "Profile To Eliminate Shadowing With Regressed Light Panels In A Luminaire And Hydrographic Printing To Modify The Surface Appearance Of The Luminaire Frame" and filed May 8, 2012, the entire contents of which are incorporated herein by reference.

TECHNICAL FIELD

Embodiments of the disclosure relate generally to lighting solutions, and more particularly to systems and methods modifying the profiles of regressed frames used with regressed light panels to eliminate shadowing and to methods of hydrographic printing to modify the surface appearance of the luminaire frame.

BACKGROUND

Flat luminous panels can appear overly bright when viewed at high angles. In order to reduce this problem, a patterned refractor or reflective louvers can be positioned along the front surface of the luminous panel. Unfortunately, these solutions are not architecturally pleasing. Another alternative is to position the luminous panel into a regressed area of the ceiling plane, thereby significantly reducing the ability to see the luminous panel at high angles.

With the luminous panel now regressed into the ceiling, some type of frame needs to be provided between luminous panel and the bottom surface of the ceiling to cover the regressed area. Options include a straight angled or flat surface, profiles emulating cove and crown molding or other similar types of molding profiles. The straight angled or flat surface is rather bland from an architectural standpoint. The cove molding and crown molding are more architecturally pleasing but their standard profiles do not work well in this type of installation. Typically, standard crown and cove molding frame profiles include curves whose tangents are parallel with the ceiling. In order to direct light onto the surface of these curves, tangents to the curve at endpoints, must intersect a portion of the luminous plane. As these luminous panels and frames are generally mounted or suspended on a ceiling, if light from the luminous panel above the frame does not intercept a portion of the curve, such a portion of the molding frame surface appears as a dark or shadowed area. When portions of the frame surface have shadows, it limits the ability to visually pick up the architectural details of the frame. Such is the case for a luminous panel positioned above the molding frame, where all of the light illuminating the profile comes from above the molding frame. Therefore, modifications need to be made to molding frames used with recessed luminous panels to ensure a sufficient amount of light emitted by the panel is intercepted by the molding frame to achieve the desired luminous gradient (transition between lighter and darker areas) across the profile of the molding frame.

SUMMARY

In an example embodiment of the present disclosure, a regressed luminaire includes a luminous panel having a substantially planar bottom surface, the luminous panel configured to be regressed into a ceiling surface. The regressed luminaire further includes at least one molding frame member disposed at least partially below the luminous panel, wherein each molding frame member includes an inner surface, the inner surface having at least one curved portion, wherein the curved portion includes a plurality of points along its curvature, each point having a tangent, wherein each tangent intersects a plane substantially parallel to the bottom surface of the luminous panel.

In another example embodiment of the present disclosure, a regressed luminaire frame includes at least one molding frame member configured to be disposed at least partially below a luminous panel, wherein each molding frame member includes a top surface and an inner surface, the inner surface having at least one curved portion, wherein the curved portion includes a plurality of points along its curvature, each point having a tangent, wherein each tangent intersects a plane substantially parallel to the top surface.

In another example embodiment of the present disclosure, a method of hydrographically printing parts of a luminaire includes the steps of providing an exterior trim part of the luminaire, applying a primer coat to an exterior surface of the trim part, placing a transfer film comprising an ink design into a water bath, applying an ink activator to the ink design on the transfer film to create an ink film layer, submerging the trim part into the water bath through the ink film layer and adhering the ink design to at least a portion of the exterior surface of the trim part, and applying a clear coat paint to the at least a portion of the exterior surface of the part.

BRIEF DESCRIPTION OF THE DRAWINGS

For a more complete understanding of the invention and the advantages thereof, reference is now made to the following description, in conjunction with the accompanying figures briefly described as follows.

Figure 1:
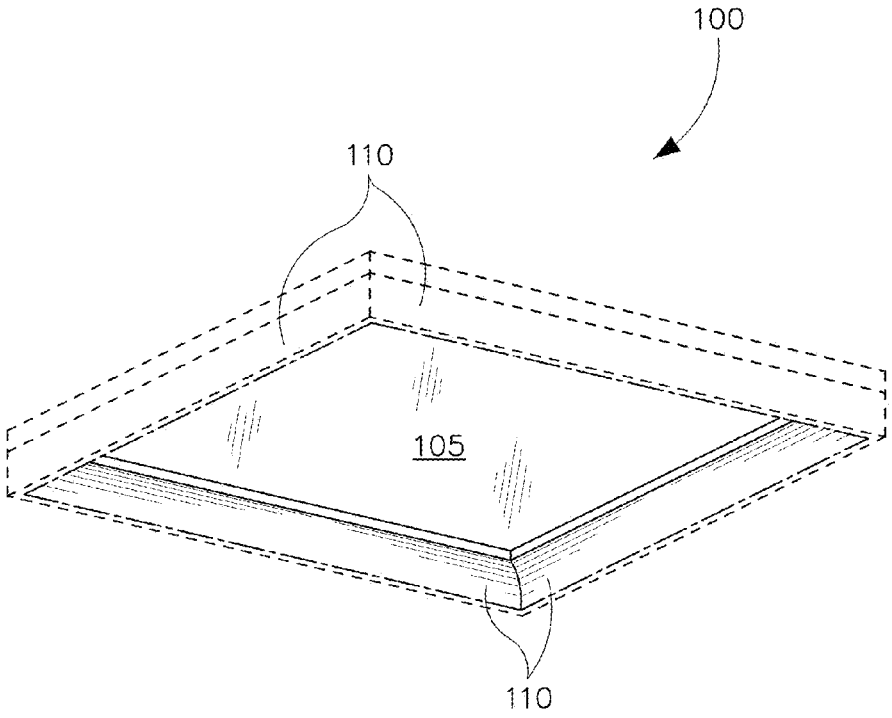
FIG. 1 is a perspective view of a regressed luminaire with modified frame curvature in accordance with an example embodiment.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Example embodiments disclosed herein are directed to a luminous panel or any other type of luminaire or light fixture where architectural framing is used with the luminaire and positioned below the light source. Example embodiments disclosed herein are also directed to methods of transfer printing on molding or other framing or housings used with luminaires using a hydrographics process. The example embodiments provide the ability to make minor modifications to generally accepted molding frame profiles to improve light gradients and reduce shading on the molding frame when used with a regressed luminous panel. The example embodiments also provide the ability to use standard metallic or plastic materials to construct the frames or housings for luminaires while providing an aesthetically pleasing print on the exterior of the housing or frame.

FIGS. 1-6 are various views of a regressed luminaire with modified cove frame curvature in accordance with certain example embodiments. Referring now to FIGS. 1-6, the example luminaire 100 includes a luminous panel 105 and one or more molding frame members 110. In certain example embodiments, the luminous panel 105 has a flat or substantially flat bottom surface that emits light into an area to be illuminated. The example molding frame members 110 can generally extend below the luminous panel 105 and are generally positioned along or near an outer perimeter of the luminous panel 105. For example, since the luminous panel 105 can be regressed into a ceiling or other surface, the molding frame members 110 can cover up the opening between the bottom surface of the luminous panel 105 and the bottom surface of the ceiling or other area into which the luminaire 100 is regressed.

In certain example embodiments, the example luminous panel 105 is an edge-lit panel and the light source for the panel 105 includes one or more light emitting diode (LED) modules. Alternatively, the luminous panel 105 is lit from above the panel and other light sources, including fluorescent and incandescent light sources can be substituted for LED light sources.

Figure 2:
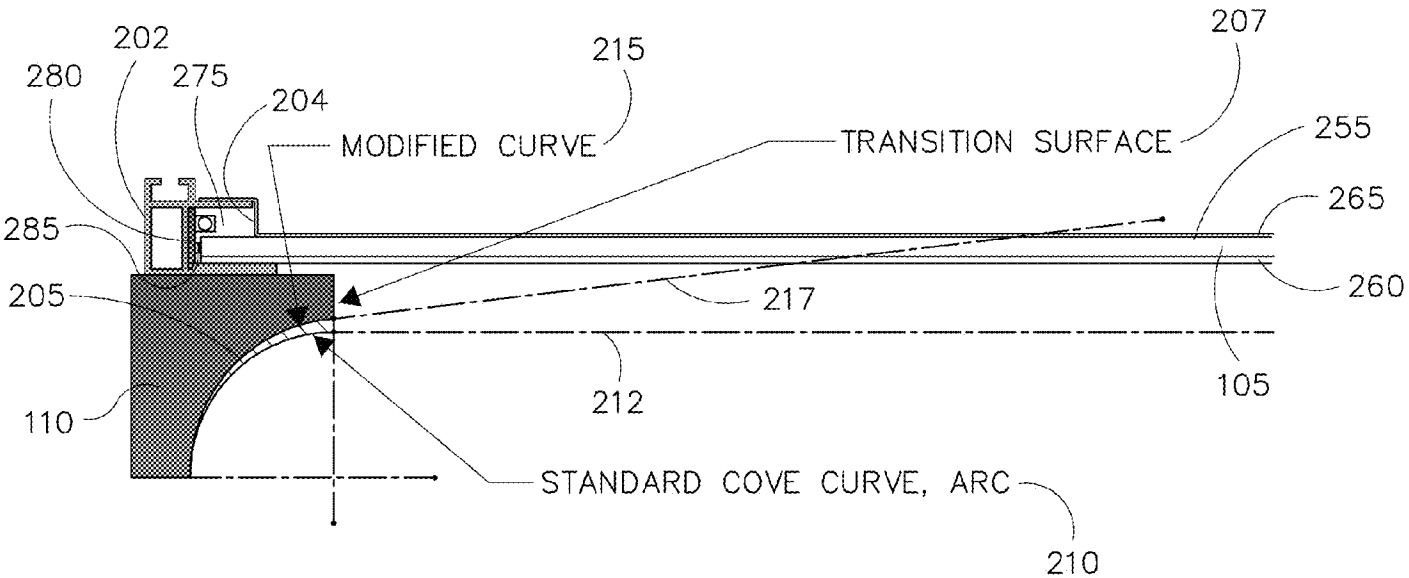
FIG. 2 is a partial cross-sectional view of the regressed luminaire of FIG. 1 in accordance with an example embodiment.

As best seen in FIG. 2, in certain example embodiments, one or more LEDs 285 are positioned within a channel 275 of one or more mounting members 202. For example, LEDs 285 can be positioned in the channel 275 of each mounting member 202, in the channel 275 of opposing mounting members 202, or in the channel 275 of just one mounting member 202. The LEDs 285 are electrically coupled to an LED driver (not shown) and can be disposed on one or more LED boards 280, such as a printed circuit board. The LEDs 285 can be one or more discrete LED dies, one or more LED packages, an array of LEDs, such as an LED strip, one or more LED chip on board devices, or an organic LED. Similarly, in certain example embodiments, any number of LED strips may be positioned in the channel 275 such that they abut one another or with any amount of space left between the LED strips. The LED strip can include a number of LEDs 285 arranged in a linear configuration on a single LED board 280, or alternatively can have any configuration such that any number of LED assemblies may be arranged in an array of any size and shape within the scope of this disclosure. Further, the LEDs 285 can include LEDs that emit white light or LEDs of differing colors to emit a wide variety of colored lights. In certain example embodiments, the LEDs 285 include LEDs that emit white light and LEDs that emit red-shifted light. These two colors can be combined in the luminous panel 105 to create a warm white light emitted from the panel 105.

Also within the channel 275 are a diffuser 260, a wave guide 255, and a reflector 265 (collectively referred to as the luminous panel 105). In certain example embodiments, each of the diffuser 260 (if included), the wave guide 255, and the reflector 265 have substantially the same shape and each is a substantially flat planar member. The diffuser 260 (if optionally included) can be positioned below the wave guide 255 and includes a bottom surface that faces an area to be illuminated.

The wave guide 255 is disposed between the diffuser 260 and the reflector 265. The example waveguide 255 has at least one edge that is disposed up against the LEDs 285 to receive the light being emitted by the LEDs 285 and distribute that light across the wave guide 255 in an effort to create a generally consistent light level across the wave guide 255. In certain example embodiments, the wave guide 255 abuts the LEDs 285 in order to receive an increased amount of light output by the LEDs 285. In certain example embodiments, the wave guide 255 is made of acrylic and includes etchings on either the top surface or the bottom surface, or both to help distribute the light received from the LEDs 285 evenly or substantially evenly across the surface area of the wave guide 255. Alternatively, the optical features of the waveguide 255 may be molded optical elements or white ink or paint silk-screened to the panel. In certain example embodiments, the wave guide 255 also includes an etched surface along the portion of the wave guide 255 facing the area to be illuminated to reduce the reflectivity of the outer surface of the wave guide 255.

In certain example embodiments, the reflector 265 is positioned above the wave guide 255 opposite the diffuser and reflects light received from the LEDs 285 and the wave guide 255 back through the wave guide 255 towards the area to be illuminated. The reflector 265 can be made of a high reflectance material, white polymers, high reflectance films, or alternatively can be made of a metallic material and painted with a white high-reflectance paint or coated with a white polymer. In certain example embodiments, a back plate 204 is positioned above the reflector 265 opposite the waveguide and coupled to one or more of the mounting members 202. For example, the black plate can be positioned along the top surface of the mounting member 202, using known coupling devices (such as screw or rivets) and methods.

Figure 3:
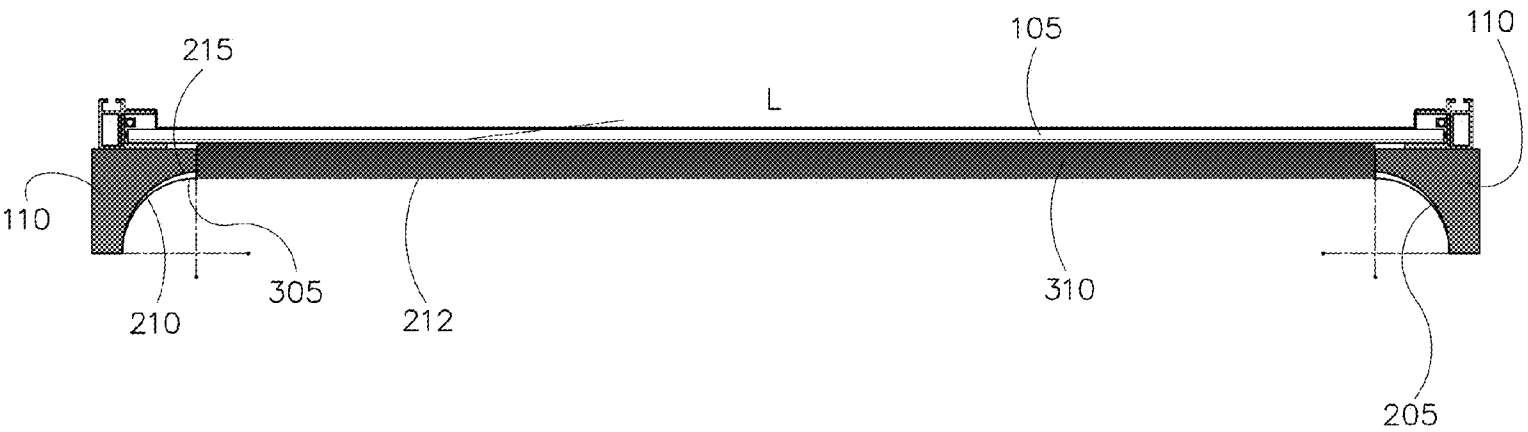
FIG. 3 is a cross-sectional view of the regressed luminaire of FIG. 1 in accordance with an example embodiment.
Figure 4:
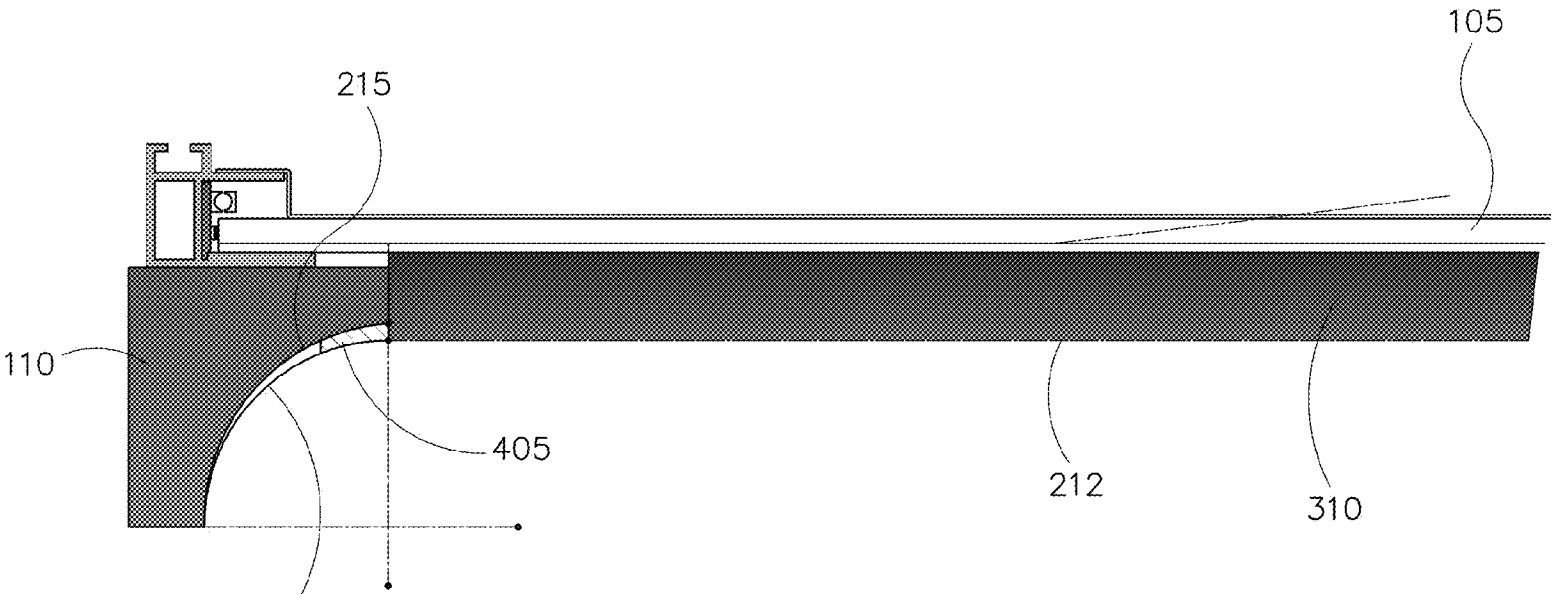
FIG. 4 is a partial cross-sectional view of the recessed luminaire of FIG. 1 in accordance with an example embodiment.

Each frame member 110 extends generally down from the mounting member 202 and is positioned such that all or portions of the frame member 110 are positioned below the luminous panel 105. As seen in FIG. 2, the frame member 110 includes an inner surface 205. FIG. 2 also shows how the shape of the inner surface 205 has been modified to allow for light to hit all portions of the surface. Specifically, element 210 presents the standard profile for a conventional cove frame member. At the top portion of the standard profile 210 for the conventional cove frame member, the arc has a tangent 212 that is parallel with or substantially parallel with the luminous panel 105. As seen in FIG. 3, the tangent 212 of the upper portion 305 never intersects with the luminous panel 105. This creates an area 310 adjacent to the luminous panel 105 that the upper portion 305 of the standard profile 210 cannot see. Since the tangent line 212 does not intersect with the luminous panel 105, a portion 405 (shown in hatching) of the conventional cove frame member having a standard profile 210 will be dark (as shown in FIG. 4). Also as seen in FIG. 4, even portions of the arc of the standard profile 210 that would have a tangent line that crosses the luminous panel 105 are within the shaded portion 405 as a result of being positioned adjacent the upper portion 305 which effectively blocks light emitted by the luminous panel 105 from hitting these areas.

Figure 5:
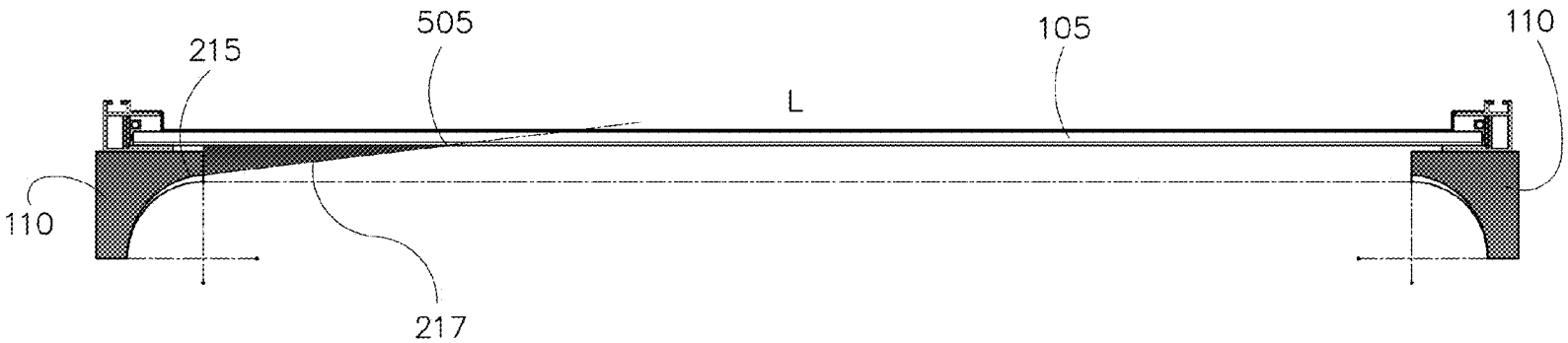
FIG. 5 is cross-sectional view of the recessed luminaire of FIG. 1 in accordance with an example embodiment.
Figure 6:
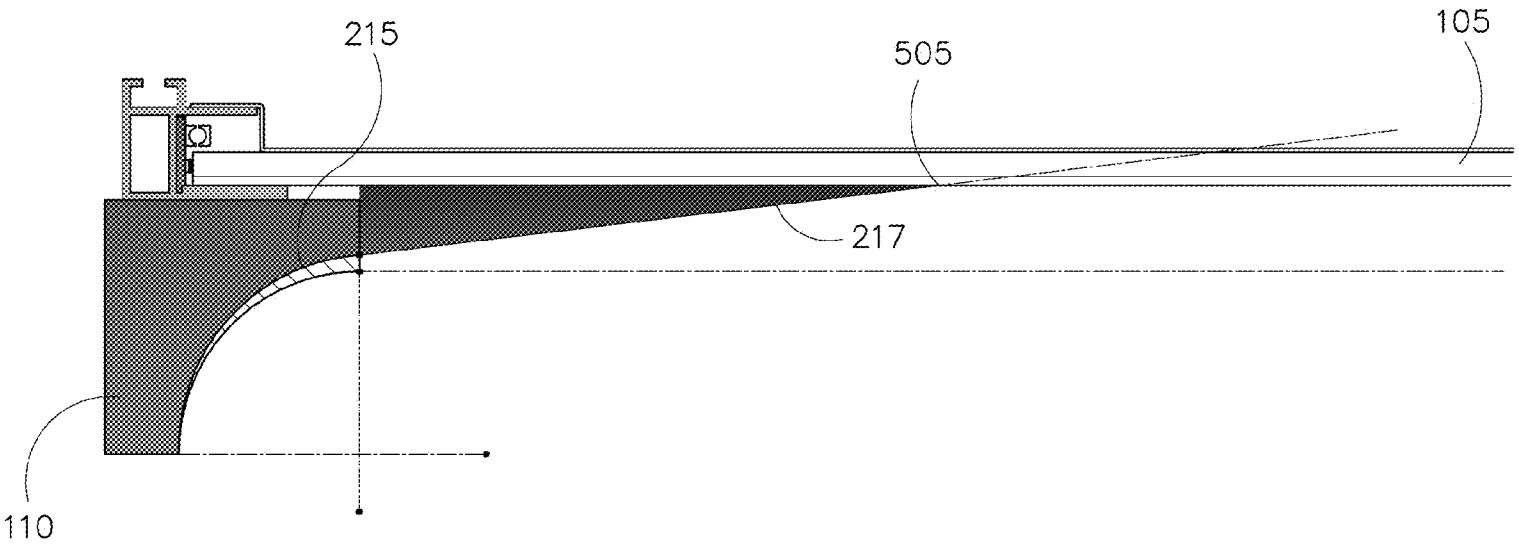
FIG. 6 is a partial cross-sectional view of the recessed luminaire of FIG. 1 in accordance with an example embodiment.

Returning to FIG. 2, the frame member 110 of the present disclosure includes an inner surface 205 having a modified profile 215. The modified profile 215 allows at least some light from the luminous panel 105 to be intercepted by all portions of the inner surface 205. Examples of how to modify the curve of the inner surface 205 are numerous and can include, but are not limited to, increasing the radius of curvature, giving the inner surface 205 an elliptical shape, providing multiple radiuses of curvature along the inner surface 205, and changing the inner surface 205 to a shape other than a true arc. With reference to FIGS. 2, 5, and 6, a tangent 217 of the edge of the modified profile 215 of the inner surface 205 adjacent to transition surface 207 has an intersection point 505 with the luminous panel 105. As such, portions of the luminous panel 105 to the right of the intersection point 505 are "seen" by the entire modified cove profile 215 and light emitted by the panel 105 to the right of the intersection point 505 is capable of hitting all portions of the modified cove profile 215.

In one example embodiment, the profile of the inner surface 205 is modified such that the tangent 217 of the arc-segment at the edge of the modified profile 215 adjacent the transition surface 207 sees two-thirds of the luminous panel 105. However, the amount of the panel 105 that the edge of the modified profile 215 sees can be adjusted such that edge of the modified profile 215 sees anywhere between 1-99 percent of the luminous panel 105. Adjusting the amount of the luminous panel 105 seen by the edge of the modified profile 215 can adjust the luminous gradient along the inner surface 205 from the edge of the modified profile 215 to the middle and lower portions of the modified profile 215. Thus, while one example modification 215 to the cove frame profile has been shown, numerous similar changes can be made based on the desired luminous gradient. Furthermore, while the example modification 215 only modified the curvature of a portion of the inner surface 205, other embodiments could also modify the lower portion of the inner surface to achieve a desired luminous gradient.

Figure 7:
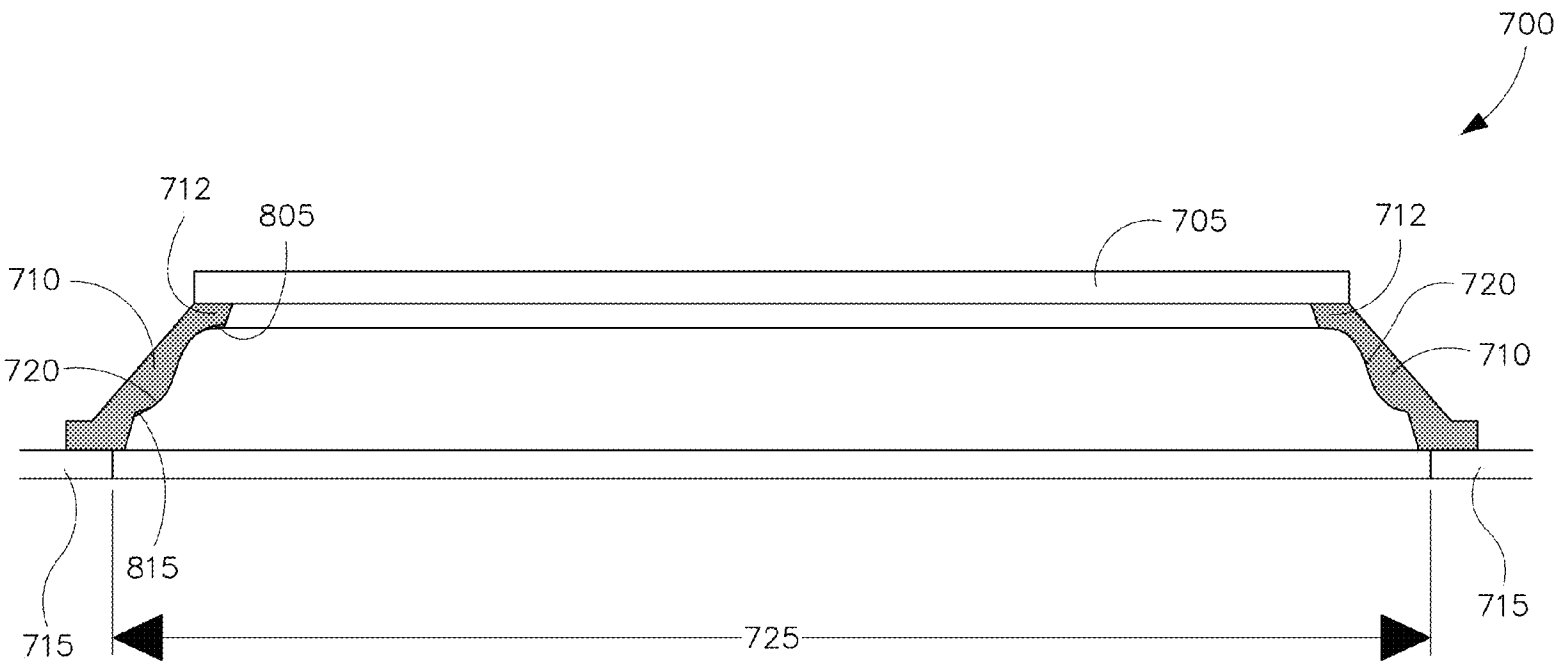
FIG. 7 is a cross-sectional view of another recessed luminaire with modified frame curvature in accordance with an alternative example embodiment.
Figure 8:
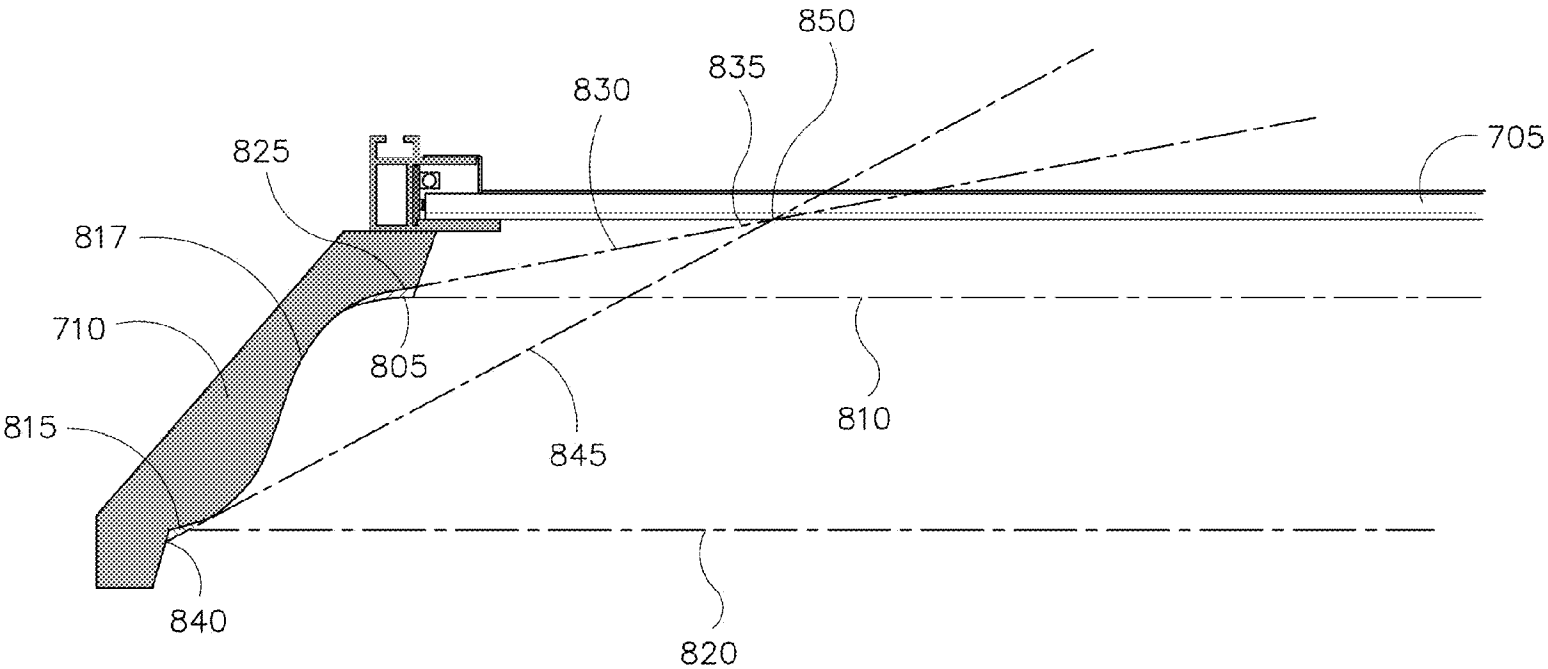
FIG. 8 is a partial cross-sectional view of the recessed luminaire of FIG. 7 in accordance with an example embodiment.
Figure 9:
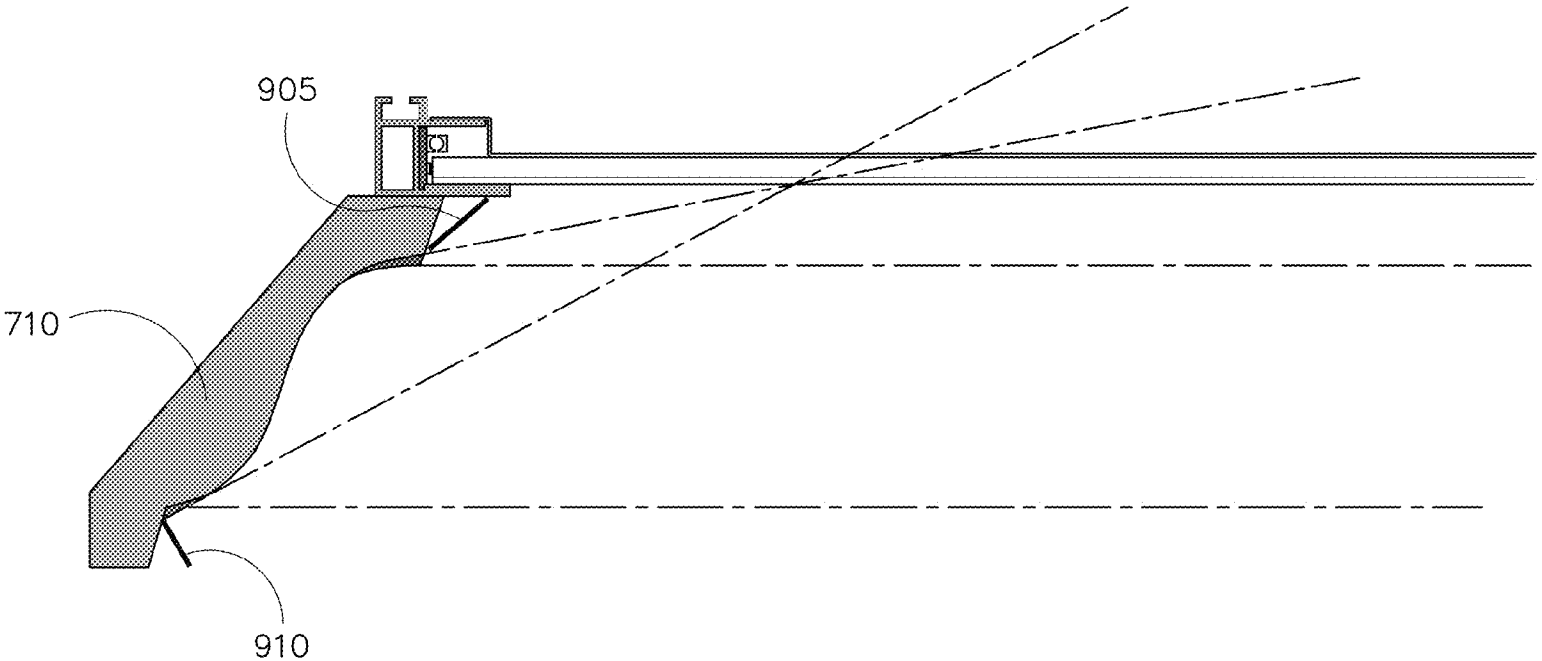
FIG. 9 is a partial cross-sectional view of another embodiment of the recessed luminaire of FIG. 7 in accordance with yet another alternative example embodiment.

FIGS. 7-9 are various views of another embodiment of a regressed luminaire 700 in accordance with certain example embodiments. FIG. 7 is a cross-sectional view of the luminaire 700 presenting a profile view of the crown molding frame members 710. The luminaire 700 is similar to that of the luminaire 100 of FIGS. 1-6 and similarities will not be repeated for the sake of brevity. The example luminaire 700 includes the luminous panel 705 disposed above the molding frame members 710. In the example embodiment of FIG. 7, the molding frame members 710 have a profile substantially in the form of crown molding that includes an inner surface 720 that includes an S-curve. The molding frame members 710 include flanges 712 that can act as a support mechanism for the luminous panel 705. Both the luminous panel 705 and all or a portion of the molding frame members 710 are disposed above a ceiling surface 715 that includes a light window 725 or opening in the ceiling to receive light emitted by the luminous panel 705 therethrough.

As best seen in FIG. 8, there are at least two portions 805, 815 (shown in hatching) of the standard crown molding profile on the inner surface 720 that have tangent lines 810, 820 respectively that do not intersect with the luminous panel 705. This will result in those two portions 805, 815 of the inner surface 720 not seeing any portion of the luminous panel 705 and having dark areas. The profile of the inner surface 720 can be modified to create a modified profile 817. The modified profile 817 changes the curvature of the first portion 805 to a modified curve 825 which has a tangent line 830 that intersects the luminous panel 705 at an intersection point 835. The modified profile 817 also changes the curvature of the second portion 815 to a modified curve 840 having a tangent line 845 that intersects the luminous panel 705 at an intersection point 850. The resulting modified profile 817 results in one in which the entire profile 817 receives at least some light from the luminous panel 705. The curvature of the two portions 805, 815 as well as other potions of the inner surface 720 may be modified to have different curvatures and tangent lines that intersect the luminous panel 705 at other intersection points based on the desire luminous gradient to be seen the surface 720 of the molding frame members 710.

In addition to modifying the S-curve portion of the inner surface 720 for the molding frame member 710, in certain example embodiments, the top transition surface 905, transitioning from the top of the S-curve to the top of the profile, and the bottom transition surface 910, transitioning from the bottom of the S-curve to the bottom of the profile, can be modified to adjust their pitch or angle with respect to the luminous panel 705. Adjusting the pitch or angle of the top 905 and bottom 910 transition surfaces can modify the amount of light they receive from the panel 705 and can change the luminous gradient of the inner surface 720 of the profile. The transition surface 207 of the luminaire 100 of FIGS. 1-6 could similarly be modified to modify the amount of light received on the transition surface 207 from the luminous panel 105.

In addition to modifying the amount of light received on molding frame members 710, the type of materials used for the molding frame members 720 can change the aesthetic look of the luminaire as a whole. For example, molding frame members 720 having a metal inner surface (that portion of which is viewed from below when looking up at the luminaire) would have a very different look aesthetically than molding frame members 720 having a wood grain inner surface or carbon-fiber inner surface. The same can be true for modifying exterior or interior housings or trims for other regressed and non-regressed luminaires. However, making each type of luminaire from many different types of materials is often not feasible for many reasons. First, it results in a much larger number of stock keeping units (SKUs). In addition, different materials perform differently and some may not be suited to extending use as a luminaire at all.

Figure 10:
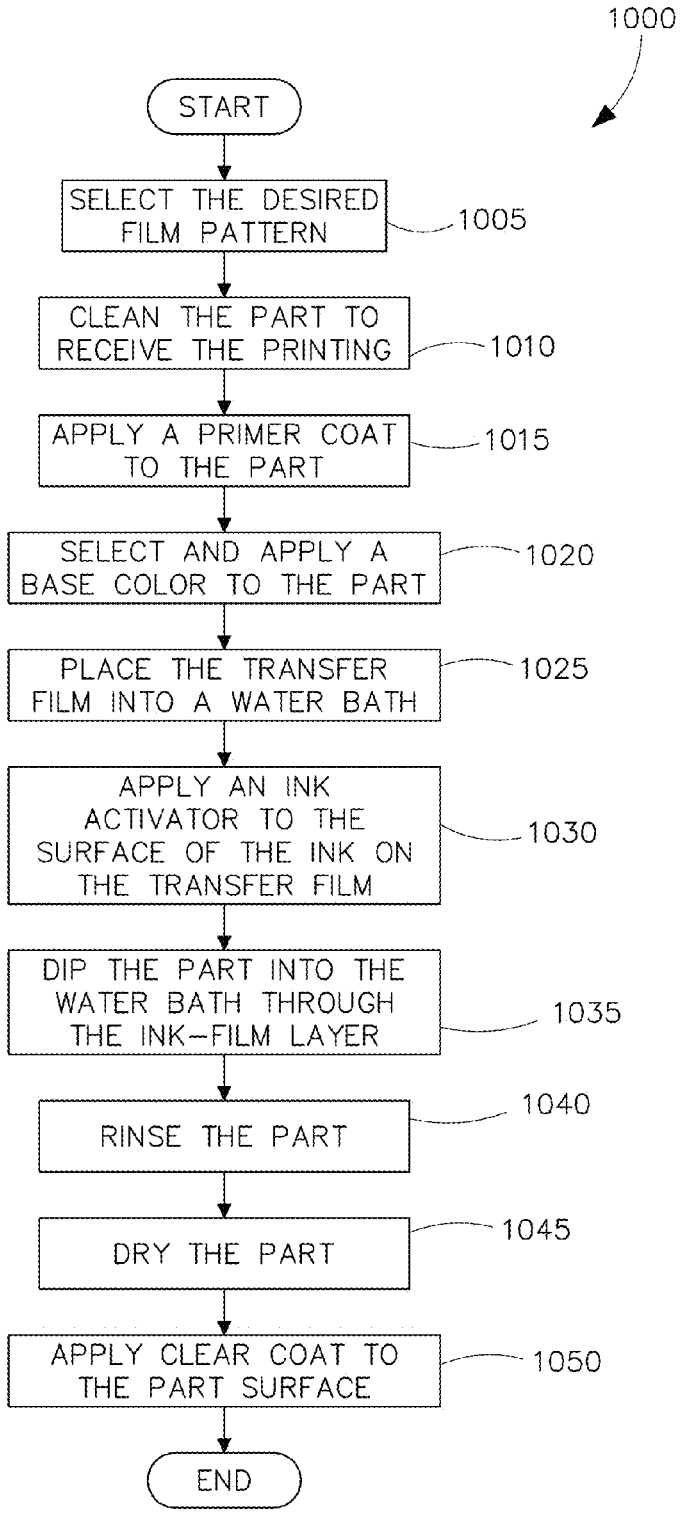
FIG. 10 is a process chart of a hydrographic printing method in accordance with an example embodiment.

However, printing graphics on a single well-performing base material to change its exterior look can provide the performance characteristics needed while providing the aesthetic look that may be desired by a consumer. One way to modify exterior or interior housings or trim parts for a luminaire is through hydrographic printing. FIG. 10 presents an example method for hydrographic printing of luminaire housings and trims. Referring now to FIG. 10, the example method 1000 begins at the START step and proceeds to step 1005 where a desired film pattern is selected for applying to an outer surface of the luminaire housing or trim. Examples of desired film patterns include, but are not limited to, any color or stain of wood grain, metal, carbon fiber, any color or design of camouflage, any color of marble, diamond plated metal, brushed aluminum, or any other design capable of being applied with ink.

In step 1010, the luminaire part (whether it be housing, frame or trim) that will receive the printing is cleaned. The type of cleaning can be based on the particular base material being used. For example, metallic parts with glossy finished can be scuffed or sanded to provide a mechanical bond between the part and the primer paint. Plastic parts can be cleaned with special chemical grease removers, flame treated to alter the molecular structure of the plastic surface and then sprayed with an adhesion promoter. Parts made of metal can be washed in special chemicals designed to remove residue and then are dried.

A primer coat of paint is applied to the part in step 1015. In certain example embodiments, an automotive grade epoxy primer is used. In step 1020, a base color is painted on to the part. The base color can give the part a uniform color and texture for the ink print to adhere to. In step 1025, the ink transfer film is placed into a water bath having a size suitable for receiving the part submerged therein. In one example embodiment, the ink transfer film is made of polyvinyl alcohol (PVA) film that dissolves in water. The water bath can be heated to about 31 degrees Celsius to begin the process of the PVA film dissolving. Once the film has begun dissolving, but still retains enough elasticity to hold the printed ink in the desired pattern, an ink activator is applied to the ink surface in step 1030. In one example embodiment, the ink activator is sprayed onto the ink surface. The ink activator softens the ink and helps make it stick to the part.

In step 1035, the part is dipped into the water bath through the ink film layer. In one example embodiment, pressure from the water closing in around the object forces the ink onto the painted surface of the part. Once the part is submerged, any remaining ink will not stick to the wet surface of the part. The part is removed from the water bath an rinsed with warm water in step 1040. In step 1045, the part is allowed to dry. Once dry, a clear coat of paint can be applied to the part surface to protect the new surface design. In one example embodiment, an automotive grade, UV protected, urethane, clear coat paint is applied to the part surface in one or multiple coats. The process then continues to the END step.

While the example embodiment has been described with reference to a part for a luminaire, the same process can be used for trims and other decorative accents that may be added on to a luminaire or provided as part of a retrofit kit to change the aesthetic look of an exterior of a luminaire, such as through replacement trims, molding frames or exterior or interior portions of the housing.

Although the disclosure is described with reference to example embodiments, it should be appreciated by those skilled in the art that various modifications are well within the scope of the disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A regressed luminaire comprising:

a luminous panel having a substantially planar bottom surface, the luminous panel configured to be regressed into a ceiling surface;

at least one molding frame member disposed at least partially below the luminous panel, wherein the at least one molding frame member comprises an inner surface, the inner surface comprising at least one curved portion, wherein all points along the curvature of the curved portion have a tangent which intersects a plane substantially parallel to the bottom surface of the luminous panel.

2. The regressed luminaire of claim 1, wherein the luminous panel comprises one or more LED modules.

3. The regressed luminaire of claim 1, wherein light is emitted through the bottom surface of the luminous panel.

4. The regressed luminaire of claim 3, wherein light emitted through the luminous panel reaches the entire inner surface of the at least one molding frame member.

5. The regressed luminaire of claim 1, wherein the at least one curved portion comprises an S-shaped curvature.

6. The regressed luminaire of claim 1, wherein the at least one molding frame member comprises a base material and film pattern printed onto the base material.

7. The regressed luminaire of claim 6, wherein the film pattern provides an aesthetic appearance to the molding frame member.

8. A regressed luminaire frame comprising:

at least one molding frame member configured to be disposed at least partially below a luminous panel, wherein the at least one molding frame member comprises a top surface and an inner surface, the inner surface comprising at least one curved portion, wherein all points along the curvature of the curved portion have a tangent which intersects a plane substantially parallel to the top surface.

9. The regressed luminaire frame of claim 8, wherein light emitted from the luminous pane in the direction of the at least one molding frame member and perpendicular to the plane is seen by the entire inner surface of the at least one molding frame member.

10. The regressed luminaire frame of claim 8, wherein the at least one curved portion comprises an S-shaped curvature.

11. The regressed luminaire frame of claim 8, wherein the at least one molding frame member comprises a base material and film pattern printed onto the base material.

12. The regressed luminaire frame of claim 11, wherein the film pattern provides an aesthetic appearance to the molding frame member.

13. The regressed luminaire frame of claim 11, wherein the film pattern is hydrographically printed onto the base material.

14. The regressed luminaire frame of claim 8, comprising four molding frame members arranged in a rectangle, wherein each of the molding frame members comprises the inner surface, and wherein the inner surfaces of the molding frame members face the inside of the rectangle.

* * * * *